US006392317B1

(12) United States Patent
Hall et al.

(10) Patent No.: US 6,392,317 B1
(45) Date of Patent: May 21, 2002

(54) ANNULAR WIRE HARNESS FOR USE IN DRILL PIPE

(76) Inventors: David R. Hall; Joe Fox, both of 2185 S. Larsen Pkwy., Provo, UT (US) 84606

( * ) Notice: Subject to any disclaimer, the term of this patent is extended or adjusted under 35 U.S.C. 154(b) by 112 days.

(21) Appl. No.: 09/642,604

(22) Filed: Aug. 22, 2000

(51) Int. Cl.[7] ..... H04B 15/00

(52) U.S. Cl. ..... 307/90; 340/853.1; 340/854.3; 340/854.9; 439/13; 439/191; 174/47; 324/323

(58) Field of Search ..... 307/90, 89, 104; 340/853.1, 854.3, 854.9; 439/13, 191, 194; 174/47; 324/353, 351, 35, 323; 175/104

(56) References Cited

U.S. PATENT DOCUMENTS 3,696,332 A * 10/1972 Dickson, Jr. et al. ... 340/18 LD 4,884,071 A * 11/1989 Howard ..... 340/854

* cited by examiner

*Primary Examiner*—Josie C Ballato
*Assistant Examiner*—Robert L Deberadinis

(57) ABSTRACT

An annular wire harness for use in drill pipe comprising two rings interconnected by one or more insulated conductors. The rings are positioned within annular grooves located within the tool joints and the conductors are fixed within grooves along the bore wall of the pipe. The rings may be recessed within annular grooves in order to permit refacing of the tool joint. The rings are provided with means for coupling a power and data signal from an adjacent pipe to the conductors in such a fashion that the signal may be transmitted along the drill pipe and along an entire drill string.

21 Claims, 7 Drawing Sheets

ANNULAR WIRE HARNESS FOR USE IN DRILL PIPE

RELATED APPLICATIONS

None

BACKGROUND OF THE INVENTION

This invention relates to fitting a wire harness inside a section of drill pipe that is used to form at least a portion of a drill string for drilling oil, gas, and geothermal wells. More particularly, this invention relates to a wire harness capable of transmitting power and data through the drill pipe. The harness may be connected to sensors and transducers in drilling tools, such as drill bits, mud motors, reamers, or MWD devices so that the data and power may be transmitted along the drill string to and from the surface during the drilling operation.

The following patents describe various attempts to transmit data and power along the drill string. To date none of these proposals have achieved commercial implementation due in part to their complexity, expense, and incompatibility with traditional drill pipe design and manufacturing methods as well as to maintenance procedures for the pipe joints.

U.S. Pat. No. 3,696,332, incorporated herein by this reference, teaches a direct contact means for transmitting power across the mating tool joint. The invention discloses the use of insulated conductor segments, ring shaped metal connectors, and a resilient biasing means located in the pipe joints. The electrical connectors contain a generally ring-shaped and substantially full circle contact-making conductive metal portion that is: located within a annular groove within a pipe joint element; electrically insulated from the groove walls; and is electrically connected to an insulated conductor.

U.S. Pat. No. 4,445,734, incorporated herein by this reference, teaches the use of an insulated wire segment located within a liner and direct electrical contacts. Two types of contacts are disclosed and are mounted so that when the drill pipe is screwed together, the sides of the contacts contact one another to make the connection. A flexible and a rigid ring are employed in the joint. The flexible ring is urged towards the rigid ring by means of a pressure conduit in communication with the drilling fluid. The insulator for the rings features a wiping mechanism so that as the rings come together, contaminants that would otherwise impede the connection are wiped away.

U.S. Pat. No. 4,220,381, incorporated herein by this reference, teaches the use of electrodes exposed to the drilling fluid to make the connection across the joint. The electrodes are connected to conductors that are shielded by an aluminum or plastic drill pipe liner, or a conduit sprung against the walls of the pipe bore.

U.S. Pat. No. 4,884,071, incorporated herein by this reference, teaches the use of a Hall Effect coupling transmitter/receiver as a means for bridging the drill pipe joint. Data is produced downhole by sensors located along the drill string or in downhole tools. The sensors are provided with a power supply for transducing the data and sending it to the pipe joint where it is received by a Hall Effect coupling transmitter. The data is then received by a Hall Effect received across the joint and forwarded through conductors up the drill string to the surface. The conductors are protected from damage by being inserted into conduits sprung against the side of the pipe bore.

Those skilled in the art are also referred to U.S. Pat. Nos. 6,041,784 and 6,057,784, incorporated herein by these references, for additional proposals for transmitting a data signal along the drill string.

What is needed is a wire harness for conveying power and data along the drill pipe that is simple in design, inexpensive, reliable, and non-intrusive to contemporary field usage.

SUMMARY OF THE INVENTION

This invention presents a drill pipe wire harness for transmitting power and data along the length of a section of drill pipe and, accordingly, the entire length of the drill string. The wire harness is particularly useful in electromagnetic inductive coupler applications, but it may also be adapted to other non-contact systems such as a Hall-Effect coupler, as well as direct and indirect contact connections. The harness consists of two rings joined by one or more insulated conductors. Alternatively, it may consist of a ring connected to one or more sensors by one or more insulated conductors. The rings are positioned within the tool joints of the drill pipe and the insulated conductors are strung along the inside bore wall of the pipe. The conductors may be cemented into grooves formed in the bore wall; they may be shielded by, or woven into, a pipe liner; or they may be housed in conduits within the bore of the pipe. In this manner, they may be protected from abrasive drilling fluid and tools passed through the bore of the pipe during the drilling operation. Each ring is provided with a means for connecting the conductors to a means for transmitting power and data. It is also contemplated that either or both rings may comprise the means for transmitting power and data.

DETAILED DESCRIPTION OF THE INVENTION

The need for transmitting data and power along the drill string used in drilling oil, gas, and geothermal wells has been recognized for nearly a century. Although there have been many proposals for meeting this need, the only system to gain commercial acceptance is the mud impulse system which is complex, expensive, limited to a baud rate of a few bits per second, and is ineffective over distances greater than 10,000 feet. Prior proposals have sought to transmit power and data by different electrical, electromechanical, electromagnetic, acoustic, or fiber optic means as a way to increase baud rate and the effective distance over which data may be transmitted. Among the reasons for the lack of commercial acceptance for these proposals are that they, too, are complex, expensive, unreliable, and fail to take into consideration contemporary drill pipe design and manufacturing methods together with the drill string makeup and tool joint maintenance procedures employed on the drill rig. Furthermore, the serial nature of the segmented drill string presents unique challenges for power and data transmission in that in a single drill string there may be hundreds of pipe joints to bridge in order to achieve transmission from the bottom of the borehole to the surface. An object of this invention, then, is to present a wire harness that will enable the transmission of high speed data and power along the drill pipe and across pipe joints without substantially interfering with contemporary drill pipe design and manufacturing methods. Also, the wire harness is intended to be transparent to drill rig makeup procedures and accommodating of tool joint maintenance. The wire harness of this invention enables two-way transmission of power and data with sensors and transducers placed at strategic locations along the drill string and downhole tools, including the drill bit. The wire harness serves as a means for transmitting power and data through conductors positioned along the bore wall of drill pipe segments. The harness is provided with a means for electromagnetically connecting, or coupling, the wire harnesses of each additional pipe segment as the drill string is assembled. Coupling means that may be used with the wire harness include an electromagnetic inductive coil, a Hall Effect coupler, or a direct contact mechanism. The various aspects of the present invention will be further described in reference to the following drawing figures, which are by way of illustration only, and are not intended to restrict the scope of this invention, since those skilled in the art may recognize aspects of this invention which are not depicted but which are intended to be included in the scope thereof.

Figure 1:
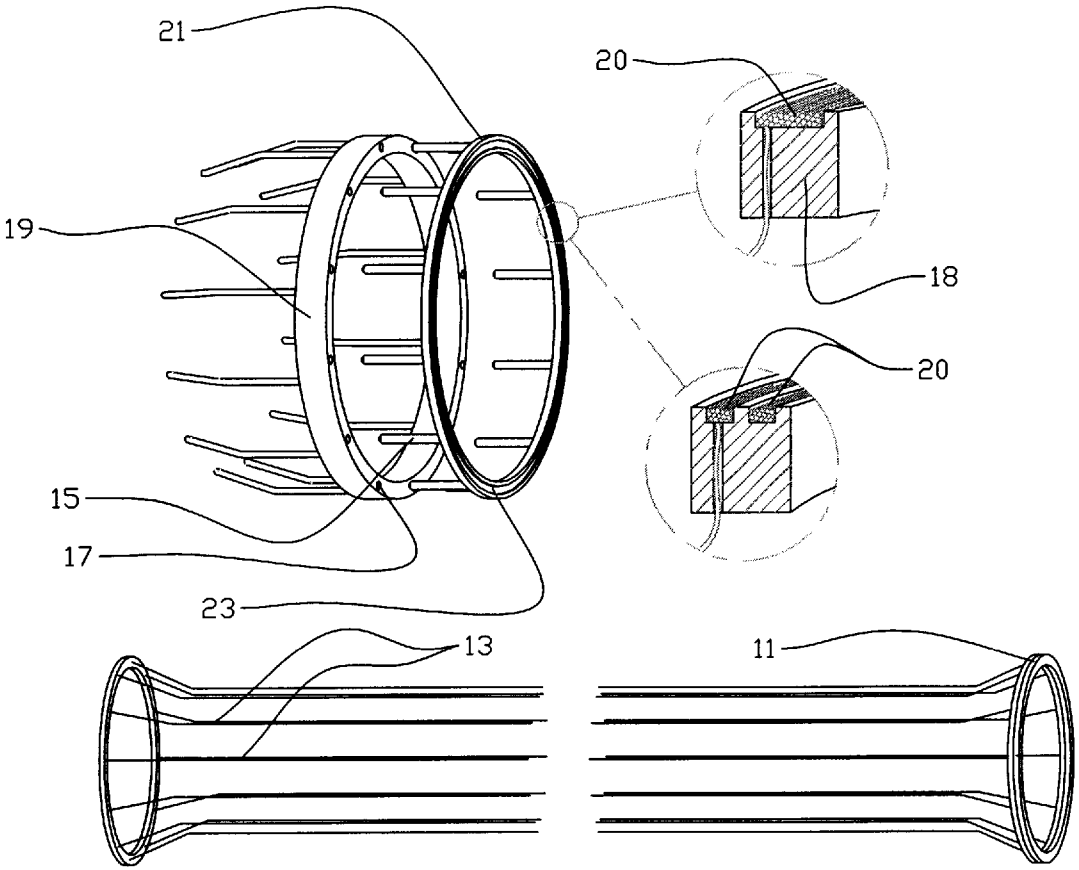
FIG. 1 is a diagrammatic view of the wire harness of the present invention.

FIG. 1 is a diagram depicting features of a wire harness of the present invention. The wire harness comprises at least one annular ring 11 or 19 joined by one or more insulated conductors 13. The conductors may consist of single strands of wire, twisted pairs of wire, coaxial cable, or fiber optic cable. They are strung along the inside bore wall of the drill pipe and held in place by a coating or liner within the drill pipe. The conductors may also be installed in grooves formed in the inside or outside surface of the bore wall of the drill pipe and attached using an abrasion resistant coating or liner, or they may be fed through conduits. If left unshielded in the bore, the conductors are likely to be shorted or damaged by the abrasive drilling fluid or by tools fed downhole through the bore of the drill pipe. The rings 11, 18, or 19 are composed of a material selected from the group consisting of metals, ceramics, or ferrites having a magnetic permeability greater than 1 and comprise a means for connecting the conductors to a coupling means 23 for transmitting the data and power signal across the tool joint of the pipe. In some applications, it may be desirable produce at least a portion of the rings from an electrically nonconducting material in order to prevent shorting to the adjacent pipe. As depicted, the coupling means 21 may comprise one or more pins 15 and the ring may comprise one or more mating receptacles 17. Within the ring, the receptacle 17 is connected to the conductors 13, so that when the coupling means is plugged into the ring a connection is made between the coupling means and the conductors. The face 23 of the coupling means 21 comprises one or more electromagnetic inductive coils axially or radially wound, or a combination thereof, within one or more grooves, a Hall Effect Coupler mechanism, an acoustic coupler, or direct contact mating surfaces. In applications where the means for coupling 20 is contained within the ring portion 19 of the wire harness, the means for coupling is connected directly to the conductors. Alternatively, the electromagnetic inductive coupler may comprise an annular circuit board having radial, toroidal, or segmented traces printed thereon that are capable of producing a magnetic field. The annular circuit board may be layered providing redundancy for the system.

Figure 2:
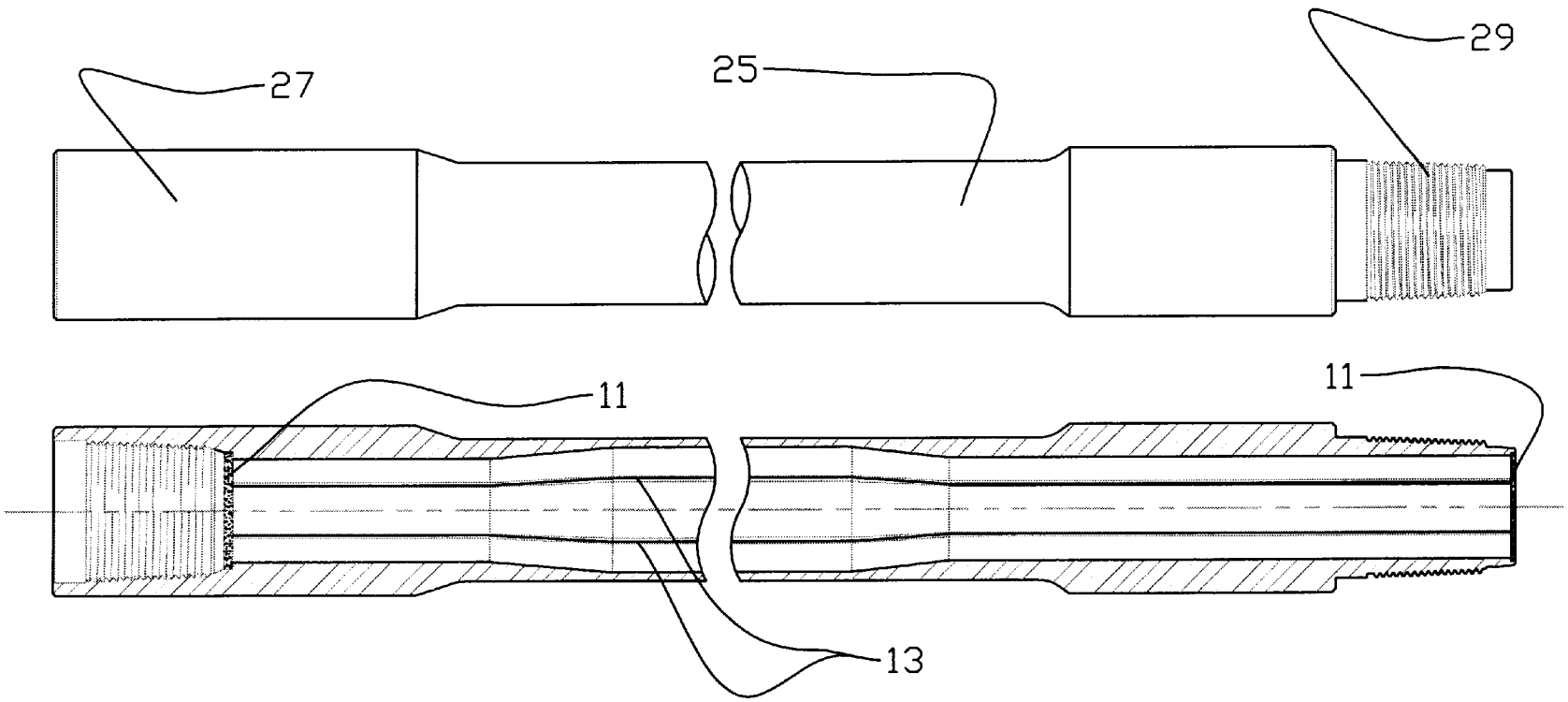
FIG. 2 is a diagrammatic view of a section drill pipe showing the wire harness positioned therein.

FIG. 2 depicts a length of drill pipe 25 consisting of a pin end tool joint 29 and a box end tool joint 27. The wire harness of the present invention is depicted within the pipe segment with rings 11 positioned within the tool joints and insulated conductors 13 strung along the inside bore wall of the pipe. The rings are deployed within grooves within the internal shoulder or the counter bore portion of the box end tool joint and on the face of the pin end tool joint. The conductors are protected from shorting and damage by being installed in grooves that run along the length of the inside of the pipe. Alternatively, the conductors may be shielded from damage by embedding them in a liner or in conduits. As pipe segments are assembled to each other by means of the their respective tool joints, the means for coupling of the wire harness are brought into contact or close proximity of each other enabling a power and data signal to be transmitted across the tool joint and along the length of the pipe through the conductors. The presence of the wire harness within the pipe transforms the pipe, which is known in the trade as "dumb iron," into "intelligent" or "smart" pipe. In the field, the sealing surfaces of the pipe joints may become damaged and require maintenance known as refacing. This procedure changes the external length of the tool joint and compensating changes must be made within the tool joint as well. By recessing the grooves, within which the rings of the wire harness are installed, beyond the dimensions allowed for refacing, the wire harness may not have to be removed when the pipe is remachined, and the recessed rings are then protected from damage due to the rough handling of the drill pipe in the field. Alternatively, the depth of the rings may be increased to permit machining without their removal.

Figure 3:
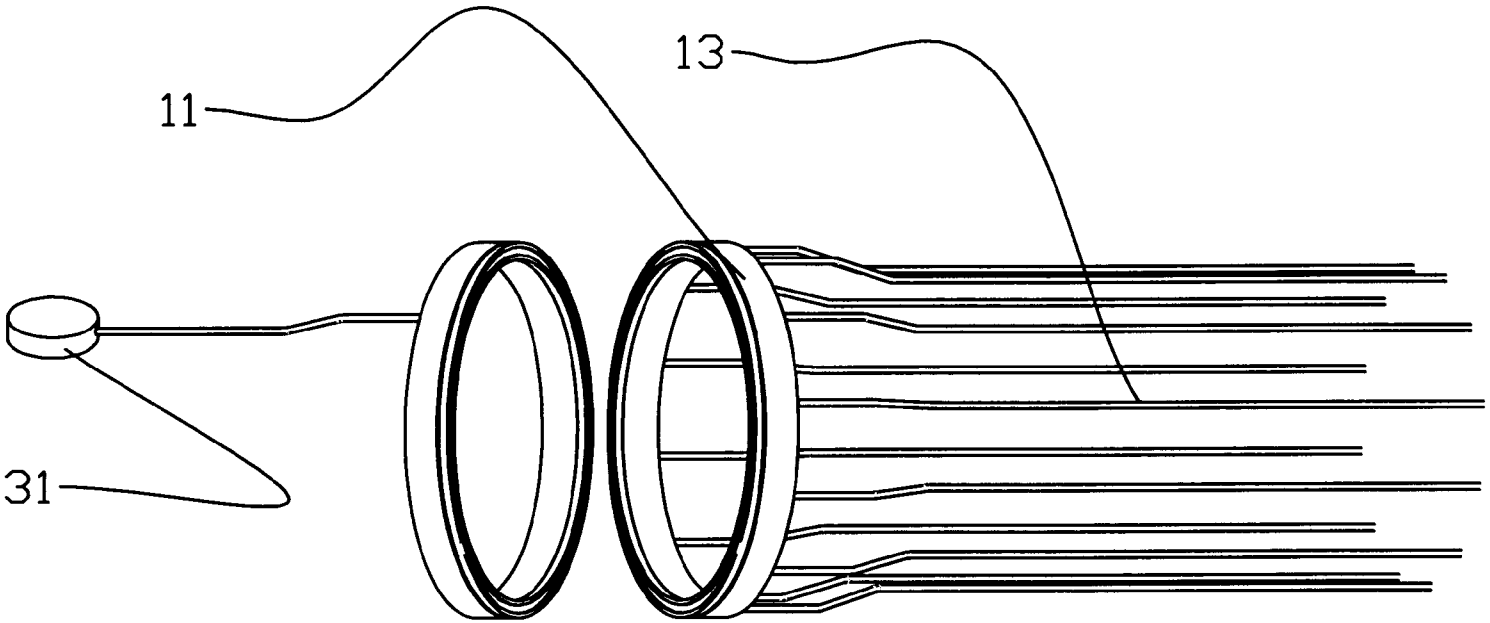
FIG. 3 depicts a sensor connected to a wire harness.

FIG. 3 is a diagram of two opposing rings 11 of wire harnesses of the present invention. A means for sensing 31 is connected to one of the rings. The means for sensing may comprise a transducer, a thermocouple, an accelerometer, a strain gauge, an inclinometer, a gamma ray detector, an acoustic source, or a geophone. Such sensors are useful in detecting the parameters of the drilling operation, the conditions of the drilling tools, and the formations being penetrated. The wire harness of the present invention enables the positioning of these sensors at strategic locations within the borehole and along the drill string.

Figure 4:
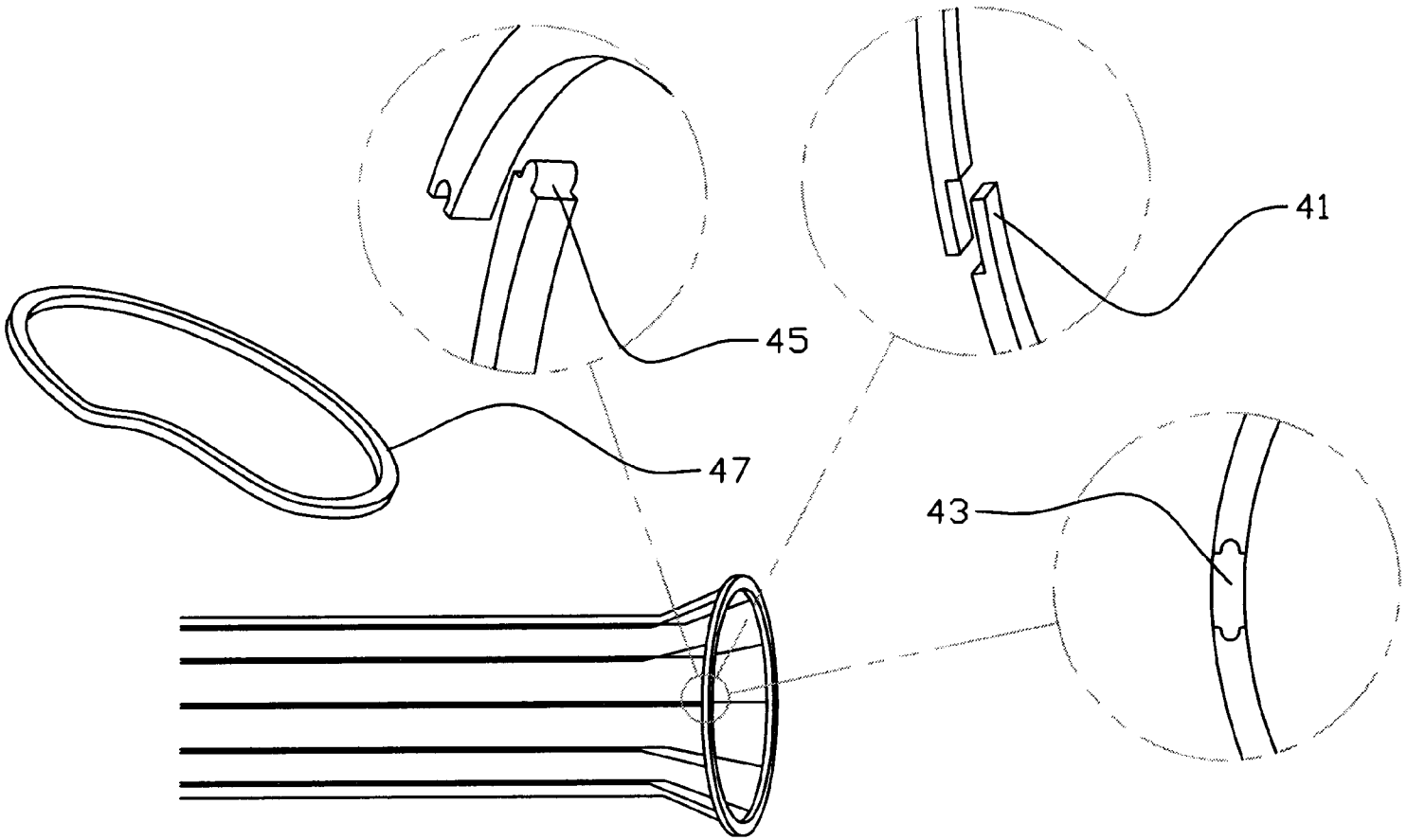
FIG. 4 depicts varies means for retracting and expanding the ring of the wire harness of the present invention.

FIG. 4 is a diagram of the various means that may be used to insert the ring of the wire harness into position within the drill pipe in applications where the wire harness is bench assembled and then installed as single unit within the pipe. The ring 47 may be composed of an elastomer so that it may be collapsed and drawn through the bore of the pipe and then expanded and sealed within the grooves of the pipe joints. Alternatively, the rings 41, 43, and 45 may be composed of a resilient, spring like metal, ceramic, or polymer that may be collapsed for insertion through the pipe and then expanded for installation into the grooves.

Figure 5:
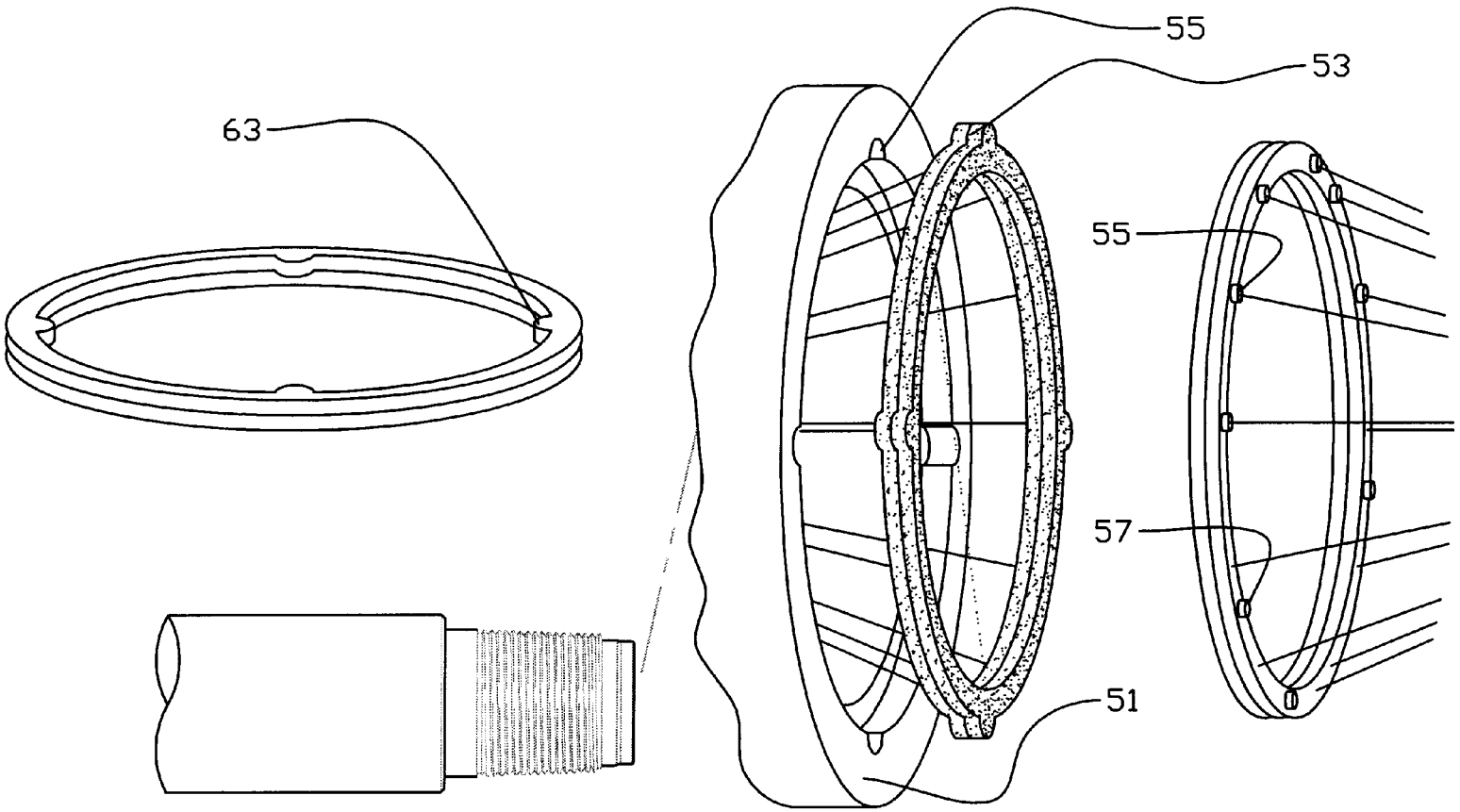
FIG. 5 is a diagram of certain anti-rotation means employed in the wire harness of the present invention.

FIG. 5 is a detailed diagram of the face 51 of the pin end tool joint of the pipe of the present invention. The groove into which the ring is inserted has key ways 55 that mate to keys 53 formed into the rings. The keys in the rings prevent rotation of the rings during the make up of the tool joint and may also serve to rotationally align the rings within the pipe. Pins 57 also serve to prevent rotation and may are designed to mate with receptacles in the groove of the joint. The pins 55 may also serve to aid in connecting the conductors to the rings. Lands 63 may be provided also as an aid for connecting the conductors to the rings. Although not depicted, the features of FIG. 5 would also apply to installation of the rings into the grooves of the box end tool joint.

Figure 6:
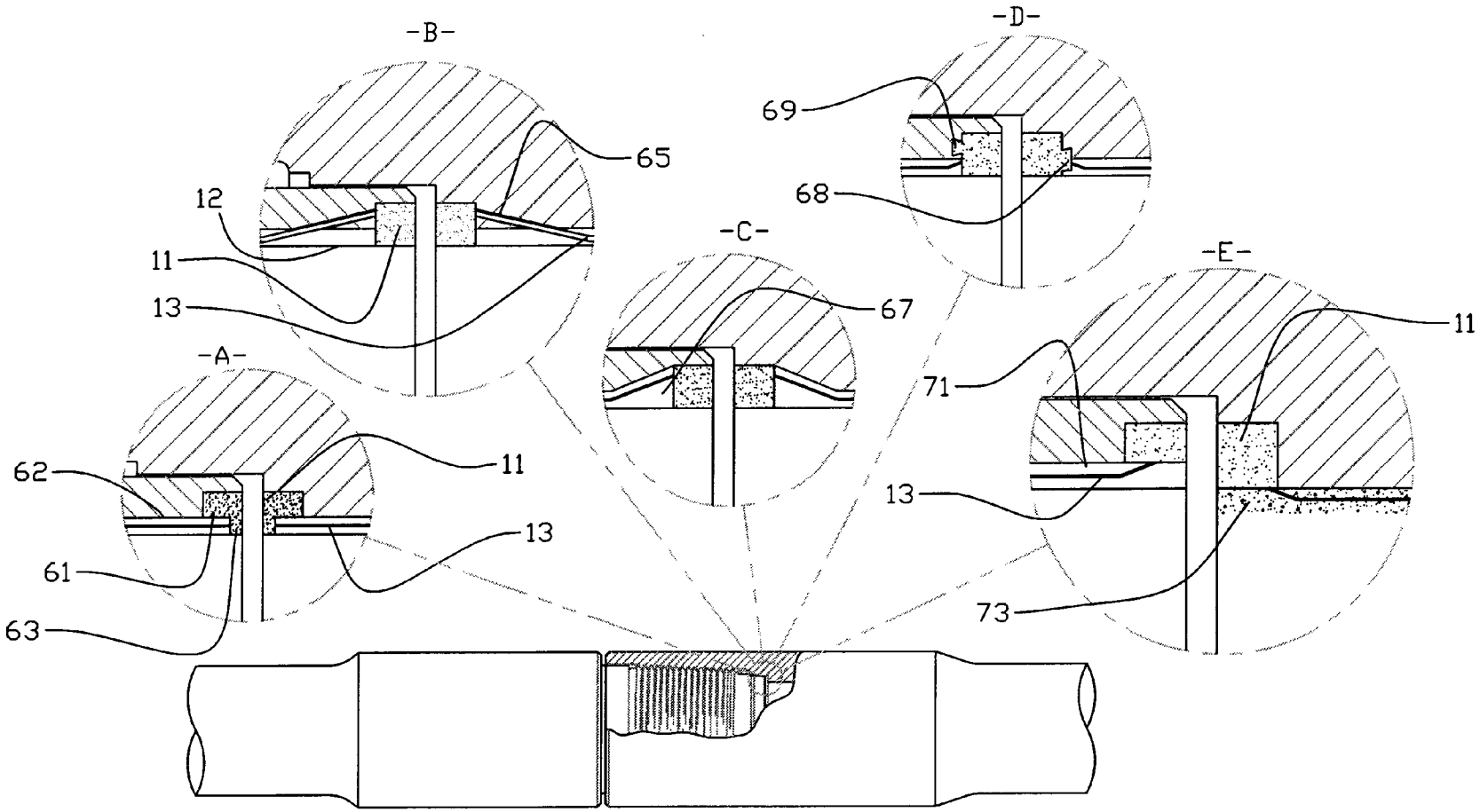
FIG. 6 depicts various orientations and methods of connecting the insulated conductors to the ring.

FIG. 6 is a diagram of an assembled, or made up, tool joint depicting various ways that the rings may be installed into the grooves and connected to the conductors. Blowup -A- depicts a conductor 13 within a groove 62 that is formed within the inside bore wall of the pipe. Rings 11 and 61 are positioned within the groove and feature a land 63 to which the conductors 13 are attached. The rings and conductors are cemented into place using an abrasion resistant adhesive that protects them from shorting and damage. The rings may be recessed in the groove in order to allow for remachining of the tool joint. Blowup -B- is another installation method of rings 11 and conductors 13. Channel 65 is provided near the groove through which the conductor may be inserted and then connected to the ring. A liner 12 is provided in the pipe to shield the conductor and rings from damage. Blowup -C- is similar to -B- except that the channel is replaced by a cut out 67 that allows direct access to the ring. The cutout is then filled with an abrasion resistant adhesive material that protects the conductor and ring and holds them in place. Blowup -D- depicts rings 68 and 69 having dovetail joints that may be used to hold the rings within the grooves of pipe joints. Blowup -E- depicts the rings 11 being attached to conductors 13 where the conductors are embedded within a lining 71 and 73 of the pipe bore. As discussed earlier, the rings in each of these applications may be recessed in the grooves so that the face of the pin end tool joint and internal shoulder of box end tool joint may be remachined without removing the wire harness.

Figure 7:
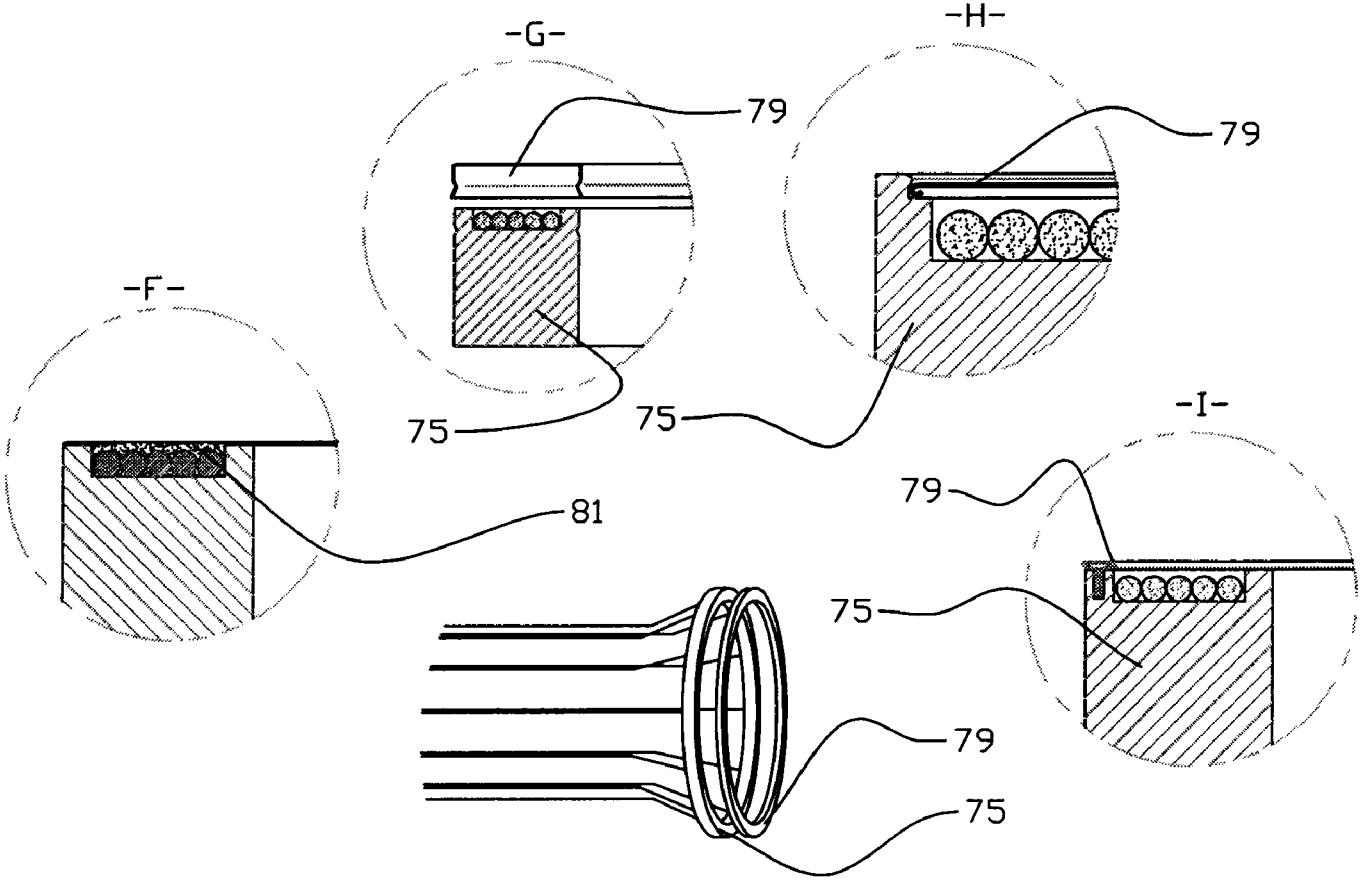

FIG. 7 is a diagram depicting applications where the ring 75 requires a cap 79 or protective coating. The cap or coating serves to protect the means for coupling. The caps may comprise and flat or non-planar self-cleaning surface that would eliminate contaminates from becoming trapped between the couplers as the pipe joints are assembled. In applications where the caps of mating couplers come in contact with each other, it may be desirable to use different materials for each cap in order to reduce the friction between the mating parts. Blowup -F- shows the means for coupling coated with an abrasion resistant material 81. Blowups -G- and -H- depict the means for coupling positioned within the ring 75 having a snap on cap 79. Blowup -I- exhibits a stand off 80 inserted into the ring 75 as a means for protecting the coupling means. The features presented here may be used in combination with one another with the intent being to protect the coupling means from damage as they are positioned proximate to, or in contact with one another. The facing surface of the rings or caps may be made convex so that they perform a wiping action as they are brought together.

What is claimed:

1. An annular wire harness for use in transmitting power and data in drill pipe, comprising:

a. ring connected to another ring, or to one or more sensors, by means of one or more insulated conductors;

b. at least one ring being provided with a means for connecting the conductors to a means for transmitting a power and data signal; and c. at least one ring being deployed within a length of drill pipe, or down hole tool having an annulus, in such a fashion that a power and data signal may be transmitted through the conductors along the section of the drill pipe which forms at least a portion of a drill string.

2. The wire harness of claim 1, wherein the rings are installed into recessed annular grooves located within the pin and box end tool joints of a drill pipe or downhole tool in such a manner that refacing of the tool joint may be achieved without removal of the wire harness.

3. The wire harness of claim 1, wherein the rings comprise a means for retraction and expansion that enables their passage through the bore of the drill pipe having one or more inside diameters.

4. The wire harness of claim 1, wherein the rings further comprise a means for preventing rotation.

5. The wire harness of claim 1, wherein the means for transmitting a power and data signal comprise an acoustic, electric, or an electromagnetic inductive means.

6. The electromagnetic inductive means of claim 5 comprising one or more axially or radially wound, or a combination of axially and radially wound, annular coils within one or more grooves.

7. The electromagnetic inductive means of claim 5 comprising an annular circuit board, within one or more grooves, having one or more layers of radial, toroidal, or segmented traces printed thereon.

8. The wire harness of claim 1, wherein the rings comprise a means for transmitting a power and data signal consisting of an acoustic, electric, or an electromagnetic inductive means.

9. The electromagnetic inductive means of claim 8 comprising one or more axially or radially wound, or a combination of axially and radially wound, annular coils.

10. The electromagnetic inductive means of claim 8 comprising an annular circuit board having one or more layers of radial, toroidal, or segmented traces printed thereon.

11. The electromagnetic inductive means of claim 1, wherein the coils or traces further comprise an abrasion resistant, low-friction coating.

12. The wire harness of claim 1, wherein the rings are further comprised of an electrically non-conducting material selected from the group consisting of polymers or elastomers.

13. The wire harness of claim 1, wherein the rings comprise flat or non-planar self-cleaning caps or coverings each consisting of a material having different frictional properties.

14. The wire harness of claim 1, wherein the rings comprise an electrically conductive material selected from the group consisting of metals, ceramics, or ferrites having magnetic permeability.

15. The wire harness of claim 1, wherein the conductive material is encased within an insulating material.

16. The wire harness of claim 1, wherein the insulated conductors are selected from the group consisting of single strands or twisted pairs of copper wires, coaxial cables, or fiber optic cables.

17. The wire harness of claim 1, wherein the means for connecting the conductors to the means for transmitting power and data comprises a pin and receptacle connector.

18. The wire harness of claim 1, wherein the means for connecting the conductors to the means for transmitting power and data comprises a direct contact connector.

19. The wire harness of claim 1, wherein the insulated conductors are fixed within grooves along the bore wall of the drill pipe.

20. The wire harness of claim 1, wherein the insulated conductors are secured by or embedded within a drill pipe liner.

21. The wire harness of claim 1, wherein the sensors comprise thermocouples, gamma ray detectors, accelerometers, pressure transducers, inclinometers, or strain gages for detecting the formation being drilled or the condition of a tool located within the drill pipe or downhole tools that together form the drill string.

* * * * *